US007597325B2

(12) United States Patent
Maierhöfer et al.

(10) Patent No.: US 7,597,325 B2
(45) Date of Patent: Oct. 6, 2009

(54) METHOD AND DEVICE FOR CONVEYING SHEETLIKE ARTICLES

(75) Inventors: Christian Maierhöfer, Höchberg (DE); Thomas Kübert, Karlburg (DE)

(73) Assignee: KBA-Metronic AG (DE)

( * ) Notice: Subject to any disclaimer, the term of this patent is extended or adjusted under 35 U.S.C. 154(b) by 219 days.

(21) Appl. No.: 11/550,604

(22) Filed: Oct. 18, 2006

(65) Prior Publication Data

US 2007/0102875 A1 May 10, 2007

(30) Foreign Application Priority Data

Nov. 17, 2005 (DE) ..... 10 2005 055 364

(51) Int. Cl.
*B65H 39/10* (2006.01)

(52) U.S. Cl. ..... 271/302; 271/194; 271/196; 271/197

(58) Field of Classification Search ..... 271/194, 271/196, 197, 302
See application file for complete search history.

(56) References Cited

U.S. PATENT DOCUMENTS

| | | | | |
|---|---|---|---|---|
| 815,008 | A * | 3/1906 | Davidson | 271/201 |
| 2,815,949 | A * | 12/1957 | Faeber | 271/302 |
| 4,424,966 | A * | 1/1984 | Chandhoke | 271/302 |
| 4,426,074 | A * | 1/1984 | Fischer | 271/302 |
| 5,026,249 | A * | 6/1991 | Shill | 414/789.1 |
| 5,158,278 | A * | 10/1992 | Auf der Mauer | 271/270 |
| 5,238,240 | A * | 8/1993 | Prim et al. | 271/299 |
| 5,671,920 | A * | 9/1997 | Acquaviva et al. | 271/307 |
| 6,000,695 | A * | 12/1999 | Mack et al. | 271/303 |
| 7,007,940 | B2 * | 3/2006 | Polidoro et al. | 271/3.11 |
| 2004/0245711 | A1 * | 12/2004 | Domoto et al. | 271/197 |
| 2006/0181005 | A1 * | 8/2006 | Lapointe | 271/194 |

FOREIGN PATENT DOCUMENTS

| | | | |
|---|---|---|---|
| DE | 2224395 | | 11/1973 |
| DE | 2906164 | | 8/1982 |
| DE | 4314832 | | 12/1994 |
| DE | 19617503 | | 11/1997 |
| DE | 10105374 | | 8/2002 |
| EP | 58140 | A1 * | 8/1982 |
| EP | 0497002 | A1 | 12/1991 |
| FR | 2643347 | A1 * | 8/1990 |
| JP | 5289566 | | 11/1993 |

OTHER PUBLICATIONS

German Search Report.

* cited by examiner

*Primary Examiner*—Patrick H Mackey
*Assistant Examiner*—Prasad V Gokhale
(74) *Attorney, Agent, or Firm*—Walter G. Hanchuk; Chadbourne & Parke LLP

(57) ABSTRACT

The invention relates to a device for conveying sheetlike articles, in particular printed sheets, by which conveyed sheetlike articles may optionally be fed to various conveying routes, various delivery stacks being provided in particular at the end of the conveying routes. The device includes at least one conveying module (1, 2, 3, 4) having at least one continuously revolving suction belt (11) which exerts a negative pressure on the underside of an article (200) to be conveyed, and which conveys the article (200) from the start to the end of the conveying module (1, 2, 3, 4). At least one conveying module (2) is designed as a mechanical switch point in order to reroute a conveyed sheetlike article (200) in its conveying route. The invention further relates to a method for operating such a device.

19 Claims, 4 Drawing Sheets

METHOD AND DEVICE FOR CONVEYING SHEETLIKE ARTICLES

Figure 1:
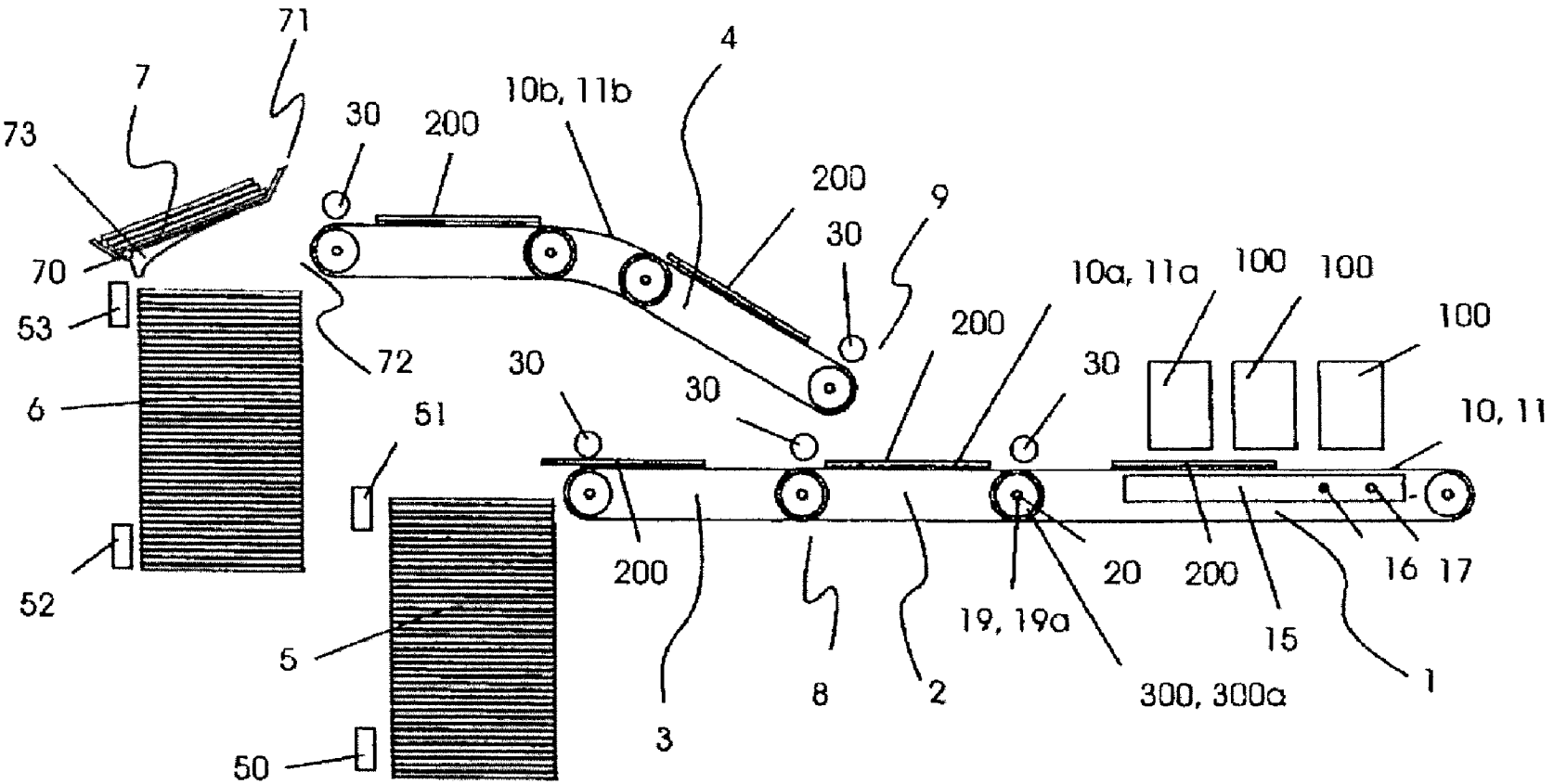

This disclosure claims priority to German Patent Application No. 102005055364.8 filed on Nov. 17, 2005.

The invention relates to a device for conveying sheetlike articles, in particular printed sheets, from a machine that processes sheetlike articles, in particular a sheet printing machine, by which conveyed sheetlike articles may optionally be fed to various conveying routes, various delivery stacks being provided in particular at the end of the conveying routes in order to deposit the articles in various delivery stacks. The invention further relates to a method for using such a device.

In the field of sheet processing machines, sheet printing machines, for example, using various printing methods such as offset printing, rotogravure printing, flexographic printing, etc., have been used for many years for printing various materials. In particular for high layers and/or thick materials, it is necessary to ensure a continuous material flow through a printing machine so that the printed sheets after printing may be deposited into stacks without stopping the printing machine or the printing process. For this purpose, a device is provided between a sheet printing machine and a delivery stack for conveying the sheets, and the device feeds the sheets exiting the machine to two different delivery stacks, optionally via two different conveying routes.

To this end, chain conveyors are used which have a revolving chain on which multiple grippers are provided by which a sheet may be gripped at an edge in order to carry the sheet along with the revolving chain.

Such devices are known from DE 24 30 212, for example, which describes a sorting device by means of which, instead of being placed on a normal conveying route to a delivery stack, misprinted sheets may be placed on an alternative conveying route to another delivery stack. The printed sheets are conveyed from a first revolving chain conveyor to a first delivery stack. Along the conveying route for the sheets from the first chain conveyor, an optionally switchable take-off drum is situated which removes the printed sheets from the grippers of the first chain conveyor and feeds them to a second chain conveyor which feeds the sheets via a second conveying route to a second delivery stack when a color density meter has identified inadequate print quality.

DE 103 29 833 likewise describes a sheet delivery device in which a single chain conveyor having multiple grippers conveys the printed sheets to successive delivery positions at which the sheets may optionally be deposited. To deliver the sheets to a first position the grippers are released at the applicable position, and the sheets are withdrawn from a conveying route by means of a swivelable sheet guide device.

In the first delivery position the sheet delivery device is designed, for example, as a mechanical switch point to remove spoiled or test sheets from the chain conveyor and redirect them to a first delivery position.

In the devices used heretofore it is disadvantageous that, in addition to a conveying device, additional guide devices for the printed sheets must always be present, since in the chain conveyors that are used the sheets would otherwise hang downward. When in particular thicker and stiffer materials such as plastic sheets are printed, there is a risk that the grippers of the chain conveyor may be overwhelmed by the weight of the individual sheets, causing the sheets to fall out in an uncontrolled manner.

Guide elements such as rods or rollers may prevent this, but they represent additional constructional measures and may also scratch a printed back side of the sheet. A further disadvantage is that in particular when radiation-curing printing inks are used, the dryers used must typically be installed in the interspace in the revolving chain of the chain conveyor, which represents a significant limitation in handling.

It is also disadvantageous that the function of a mechanical switch point must be integrated as a separate device into a conveying device in order to reroute the conveyed sheets.

The object of the invention is to provide a device for conveying sheetlike articles which eliminates the referenced disadvantages and which enables at least two different switchable conveying routes to optionally be provided, for example to fill various delivery stacks with sheetlike articles without having to stop the working process of the sheet processing machine, such as a printing machine, so that the machine may operate continuously. A further object of the invention is to ensure ease of handling and accessibility of drying devices for sheet printing machines.

This object is achieved by a device comprising at least one conveying module having at least one continuously revolving suction belt which exerts a negative pressure on the underside of an article to be conveyed, and which conveys the article from the start to the end of the conveying module, at least one conveying module being designed as a mechanical switch point in order to reroute a conveyed sheetlike article in its conveying route. The object is further achieved by the method according to the invention.

Within the scope of the invention, a suction belt is understood to be a conveyor belt by which a negative pressure may be exerted on a sheetlike article through openings in the belt surface, so that the article is held to the surface of the conveyor belt by suction. For this purpose, for example, a conveyor belt having through openings may be led, at least in places, tightly over an open chamber which faces the underside of the conveyor belt and in which a negative pressure is generated, so that air is drawn into the chamber through the openings in the conveyor belt. Here as well, alternative designs are possible to implement a suction belt in the sense of the invention.

A fundamental concept of the invention is that, instead of a chain conveyor having grippers for conveying the sheetlike articles and additional necessary guide devices, according to the invention the sheetlike articles are conveyed by means of at least one suction belt which on the one hand as a result of the suction effect secures the articles to be conveyed and on the other hand also supports the articles so that they cannot sag. In addition, in this design it is no longer possible for articles to become detached, which may occur with the grippers used heretofore, or for printing already present on the back side of the article lying on the suction belt to be damaged.

It is also essential to the invention that articles are conveyed by at least one conveying module, preferably by multiple conveying modules, which are consecutively positioned in the conveying direction. At least one conveying module, preferably all the conveying modules, have at least one suction belt for conveying the articles, and at least one conveying module is designed to operate as a mechanical switch point by means of which an article to be conveyed may be guided on at least two different conveying routes. Depending on the quantity of switch points, any given number of different conveying routes may be implemented.

In one preferred embodiment of the invention, a conveying route may be composed of multiple conveying modules.

In one application of the invention in conjunction with printing machines, such a device according to the invention may be used, for example, to guide printed sheets from a printing machine to various delivery stacks, for example to allow a continuous printing operation. However, any other application is possible, for example for sorting facilities in general, in which sheetlike articles pass through various conveying routes, depending on the case.

In one preferred embodiment of the invention, a conveying module forming a switch point is able to assume at least two mechanical positions in order to guide conveyed sheetlike articles on at least two conveying routes. Switching between these positions may be performed, for example, by use of a higher-level control. To change a conveying route, for example the end of the conveying module acting as a switch point may be displaceable with respect to the start of the respective subsequent conveying module.

In particular when the start (seen in the conveying direction) of a conveying module is stationary, the end of this conveying module may be easily displaced during a conveying operation, since even during the changeover period articles may continue to be guided on the conveying module, i.e., directly from a machine which processes the sheetlike articles or from a preceding conveying module. The changeover preferably is designed such that during the changeover period one or more articles are located completely on the suction belts and do not project beyond an end region of a conveying module.

By displacing the end of a conveying module, this end may be positioned with respect to a start of at least two alternative conveying routes which, for example, may be specified by the particular start of at least two further conveying modules in order to transfer a conveyed article to another conveying route or to a further conveying module.

According to the invention, a conveying route may be composed, at least in places, of at least two conveying modules, between which a sheetlike article may be transferred, in particular in a seamless manner. All conveying modules preferably have the design with suction belts according to the invention, at least one conveying module being designed as a mechanical switch point.

In this manner a conveying module which forms a switch point may be rotatably mounted about a swivel axis and optionally switched to individual swivel positions, an alternative conveying route resulting from each swivel position. In particular, a swivel axis may be formed by a rotational axis about which a suction belt revolves by means of deflection rollers.

In principle, a conveying module is designed so that at least one suction belt revolves continuously, and the region between two deflection points at the start and end of a conveying module defines the conveying route. The deflection may be achieved by means of deflection rollers which are provided at the respective deflection points.

In one preferred embodiment a conveying module may have multiple parallel suction belts, in particular suction belts separated at a distance. For example, the suction belts separated at a distance may be guided by mutually spaced deflection rollers which are all positioned on a rotational axis at a start/end of a conveying module. Each deflection roller may have its own rotary shaft, or all deflection rollers at one deflection point may be provided on a common rotary shaft.

In one preferred embodiment, a conveying route may extend over adjacent conveying modules, thereby enabling a conveyed article to be transferred in a particularly secure manner, and particularly preferably in a tangential manner between two conveying modules when the deflection rollers at the start/end of one conveying module are situated between the deflection rollers at the end/start of an adjacent conveying module. This is possible when, as previously mentioned, the individual deflection rollers at a deflection point of a conveying unit are located at a distance from one another and the respective deflection rollers of another conveying module lie within this distance. Gearing between two adjacent conveying modules may be achieved in this manner.

With such gearing it is possible, for example, for the deflection rollers at a start/end of two adjacent conveying modules to have a common rotary shaft. Likewise, the deflection rollers at the start/end of the conveying module may have separate parallel rotary shafts with separate rotational axes or also a common rotational axis. Separate rotary shafts are provided at the minimum when one of two conveying modules forms a switch point.

Figure 2:
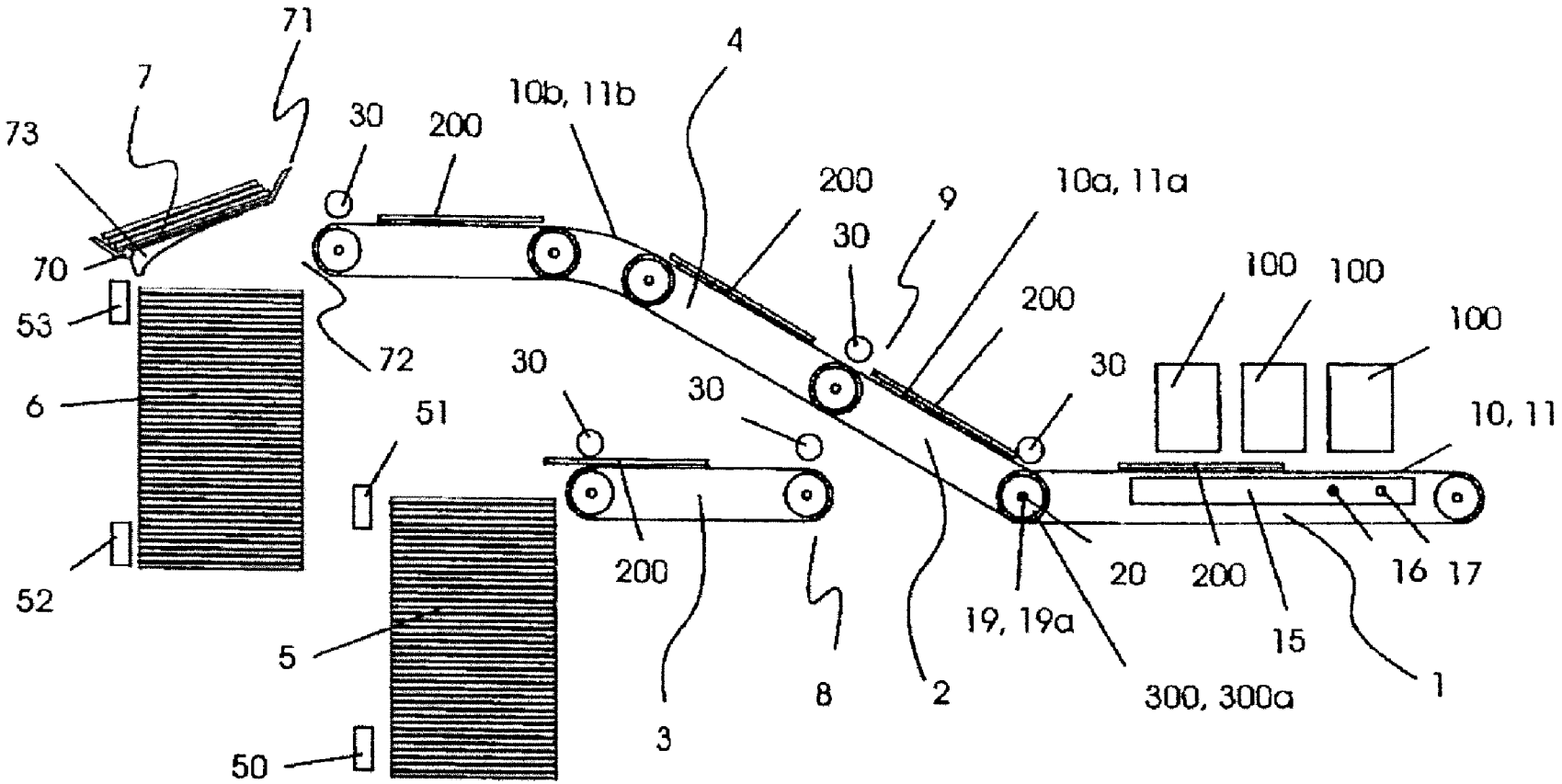
Figure 3:
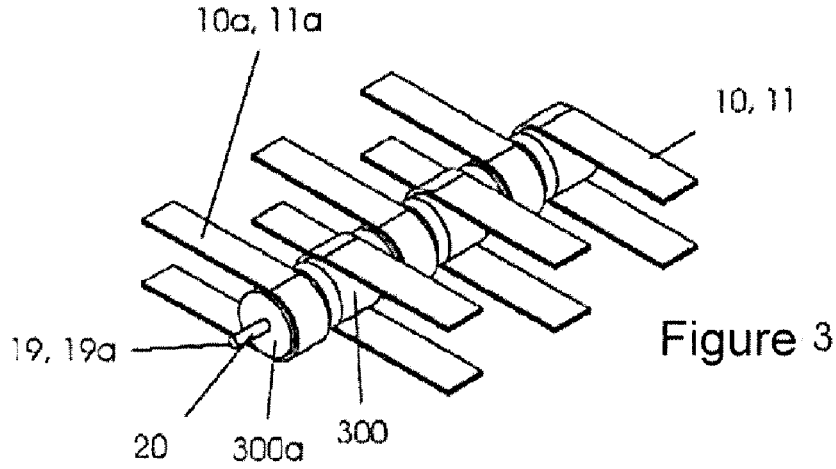
Figure 4:
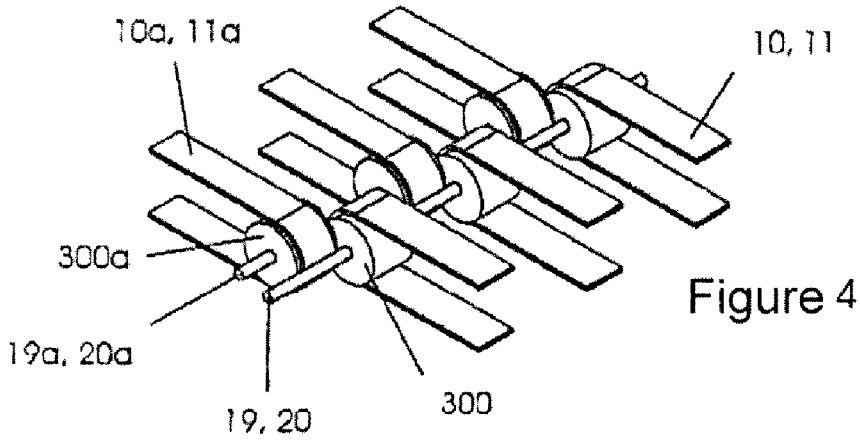
Figure 5:
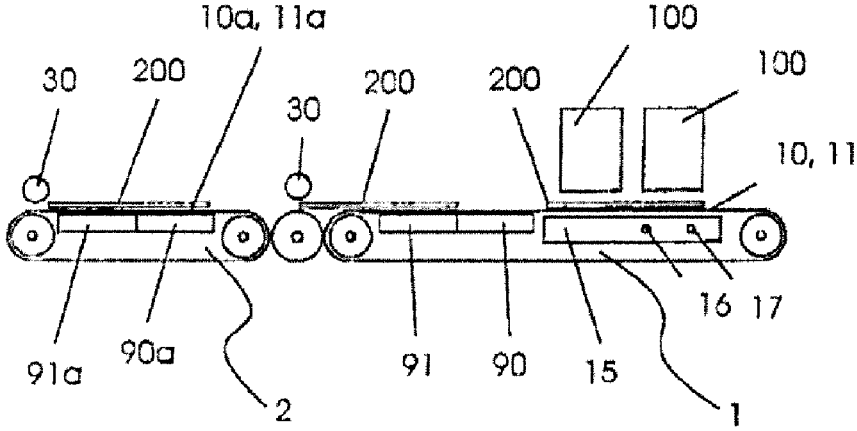
Figure 6:
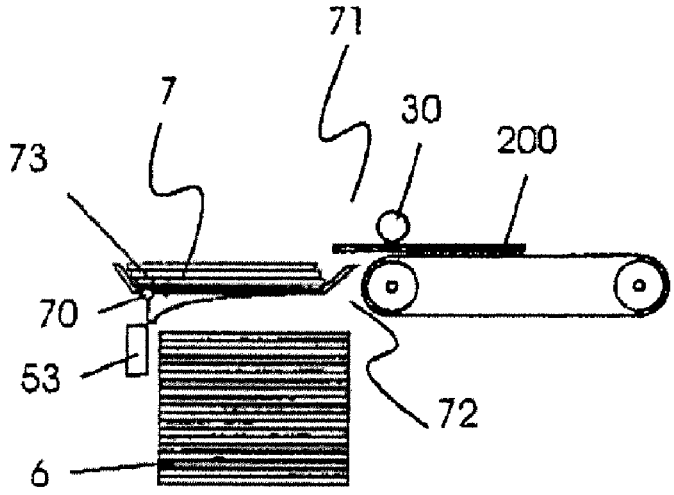
Figure 7:
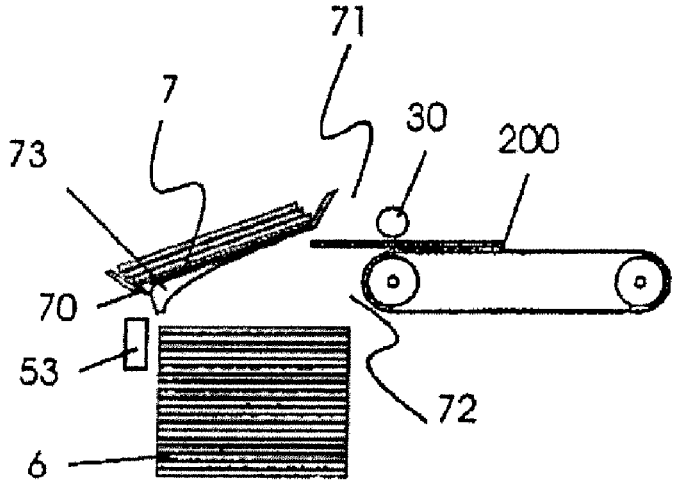

One exemplary embodiment of the invention is illustrated in the figures, which show the following:

FIG. 1: shows an overview of a conveying device having a switch point in a first position;

FIG. 2: shows an overview of a conveying device having a switch point in a second position;

FIG. 3: shows the transition between two conveying modules having a common rotary shaft for the deflection rollers;

FIG. 4: shows the transition between two conveying modules having separate rotary shafts for the deflection rollers;

FIG. 5: shows two conveying modules with a guide device situated therebetween;

FIG. 6: shows a device for receiving test sheets in the swiveled-in state; and FIG. 7: shows a device for receiving test sheets in the swiveled-out state.

The figures discussed below show by way of example the use of the device according to the invention in a printing machine for printing sheets. However, the following described features may relate to a conveying device for any use.

FIG. 1 schematically shows the design of a device according to the invention for conveying sheetlike articles, for example printed sheets from a printing machine, the device in this embodiment essentially comprising four conveying modules 1, 2, 3, 4. The printed sheets 200, after leaving the last printing unit of an upstream printing machine (not illustrated), are delivered by means of a transfer system (not illustrated), for example a known chain gripper system, to the first conveying module 1 in the conveying direction, and from there are delivered to the conveyor belts 10 which securely hold the sheets 200 by means of negative pressure. To this end, the conveyor belts 10 are designed as continuously running suction belts 11 whose speed is preferably synchronized with the printing speed of the printing machine.

In another design the suction belts 11 for the particular conveying modules 1, 2, 3, 4 may each operate independently and be driven by separate drives (not illustrated). In this manner the distance between the printed sheets 200 may be changed by the fact that in each case successive conveying modules have different conveyor belt speeds in order to optimize time-critical sequences in this design, such as during the changeover process of the conveying route for the sheets, for example from delivery stack 5 to delivery stack 6 or vice versa.

The design of such suction belts 11 is known to those skilled in the art and does not require further description here.

Drying devices 100 may be additionally provided above the conveyor belts 10 of the conveying module 1 in order to fix or cure the printing inks applied during the printing process in the upstream printing machine. When radiation-curing printing inks are used, these are UV dryers, for example.

In this case drying systems of different designs may advantageously be used, depending on the application and the requirements, since there are no constructional limitations as in the conventional design mentioned at the outset. Since drying systems such as UV dryers also emit a considerable quantity of heat which could result in impermissible heating of machine parts or even deformation or damage of the sheets 200, the internal region of the continuous closed conveyor belts 10 may be designed as a cooling device, for example as a cooling plate 15, which may be connected to a separate cooling unit (not illustrated) via lines 16 and 17. In this manner a cooling surface of a cooling device may contact the underside of a suction belt 11.

This ensures that a sheet 200 is cooled from its back side during its passage under the drying devices 100, and also that the suction belts 11 themselves are cooled, which in the absence of a printed sheet could be irradiated by the UV dryer, for example, and if uncontrolled would thus be heated or even destroyed.

In this manner it is also possible to avoid impermissible heating of the mechanical parts of the transport system, which could lead to malfunction of the machine or even to hazard for the operator.

In this case the conveying module 2 subsequent to the conveying module 1 is designed according to the invention as a mechanical switch point in order to optionally feed the printed sheets 200 via a first conveying route to a first delivery stack 5, or via a second conveying route to a second delivery stack 6. The first conveying route is essentially formed by the subsequent conveying module 3, and the second conveying route is formed by the conveying module 4.

To this end, the conveyor belt 10*a*, i.e., the end of the conveying module 2 in the conveying direction, in particular the entire conveying module, is displaced to one of two positions 8 or 9 in order to convey the printed sheets 200 either via the downstream conveying module 3 to the first delivery stack 5 or via the downstream conveying module 4 to the second delivery stack 6. FIG. 1 shows the conveying module 2 in position 8, in which the printed sheets 200 are conveyed to the conveying module 3 and from there arrive at the delivery stack 5.

In contrast, FIG. 2 shows the conveying module 2 in position 9, in which the printed sheets 200 are conveyed to the conveying module 4 and from there arrive at the delivery stack 6. In this case the changeover between the two alternative conveying routes, i.e., either via conveying module 3 or conveying module 4, occurs by swiveling the end of the conveying module 2 in the conveying direction about the rotational axis 19, which is specified by the shaft about which the conveyor belts 10, 11 revolve.

The sheets 200 may, for example, be seamlessly transferred between the respective conveying modules 1, 2, 3, 4 by the fact that the individual suction belts 11, 11*a*, of which a conveying module may contain several in parallel, are positioned in an offset manner from adjacent conveying modules in the direction of travel of the sheets such that gearing of adjacent conveying modules is obtained, as the result of which a sheet 200 is seamlessly transferred during the transport from one conveying module to the next conveying module, and also is continuously held by the suction effect of the suction belts.

The mutually offset arrangement of the individual suction belts 11 and 11*a* of adjacent conveying modules may be designed, for example as illustrated in FIG. 3, so that the respective deflection rollers 300 and 300*a* at the end or start of the adjacent conveying modules lie on a common geometric rotational axis 19, which need not be formed by a common mechanical shaft. All deflection rollers are coaxially positioned.

In particular at the transition from conveying module 1 to conveying module 2, the common rotational axes 19 and 19*a* may be identical and may be formed by the common shaft 20. This shaft 20 then also forms the shaft about which the conveying module 2 may be rotated in order to displace the end thereof with respect to the two previously mentioned positions 8 or 9.

As an alternative, as illustrated in FIG. 4 a transfer may also be achieved by partial displacement or gearing of the deflection rollers 300 and 300*a* for the adjacent suction belts 11 and 11*a*, depending on the constructional design and the requirements. The rotational axes 19 and 19*a* of the deflection rollers 300 and 300*a* for the respective suction belts 11 and 11*a* are parallel to one another, and preferably are situated as closely as possible to one another to enable an essentially seamless transfer of the sheets 200 between the conveying modules.

In both of the previously mentioned embodiments, the gearing of the deflection rollers 300, 300*a* for adjacent conveying modules is achieved by the fact that each conveying module has multiple parallel suction belts 11, 11*a* which pass over multiple deflection rollers 300, 300*a*, respectively, situated on one shaft or on separate shafts, whereby the deflection rollers associated with a conveying element are at a distance from one another, and the deflection rollers of an adjacent conveying element lie within this distance.

In a further embodiment as illustrated in FIG. 5, a guide device 30 may be provided between adjacent conveying modules, for example between conveying modules 1 and 2, which may be operated as a pull-in roller or a pull-out roller at a speed which is independent of the adjacent conveying modules, or also synchronized therewith. Such a guide device 30 may be formed by two rollers through which a base runs.

In a first embodiment the drive action of the suction belts 11 and 11*a* for the conveying modules 1 and 2 is provided by a common shaft 20 to which the deflection rollers 300 and 300*a* are attached, the deflection rollers thereby simultaneously operating as drive rollers, so that no change in speed or slip is transmitted to the sheet during transfer of the sheets 200 from conveying module 1 to conveying module 2. In addition, possible slip at the moment that the mechanical switch point formed by the conveying module 2 changes over from position 8 to position 9 may be prevented by controlling the swivel motion of the switch point, i.e., the conveying module 2, when no sheets are present in the transfer region from conveying module 1 to conveying module 2 and in the transfer region from conveying module 2 to conveying module 3 or to conveying module 4, i.e., exactly in the gap between two consecutive sheets 200.

To simplify transfer of in particular very stiff materials, a guide device 30 may be provided in the region of the rotational axes 19 and 19*a* above the suction belts 11 and 11*a*, thereby allowing the sheets 200 to press against the subsequent suction belts 11*a* and thus enabling the holding effect. Such guide devices may also be provided at all further transfer regions between the respective conveying modules 1, 2, 3, 4, i.e., at the delivery side with respect to the delivery stacks 5, 6.

The guide devices 30 may be implemented by means of guide plates, guide rods, or online or driven guide rollers. In particular for short sheets it is advantageous for the guide devices 30 to be designed as pull-in rollers or pull-out rollers, thereby compensating for a possible inadequate force effect from the vacuum-impinged suction belts in the transfer regions between the respective conveying modules and ensuring secure transport of the sheets.

The functional sequence is essentially as described below.

After the sheets 200 are printed in an upstream sheet printing machine (not illustrated), the printed sheets 200 are delivered on the suction belts 11 of the first conveying module 1 by means of a chain layout (not illustrated), the conveying speed of the chain layout and of the suction belts 11 for the conveying module 1 being the same and operating together in a synchronized manner. When the switch point of the conveying module 2 is in position 8, after the sheets 200 are transferred from conveying module 1 to conveying module 2 the sheets are transported via the conveying module 3 to the delivery stack 5 and are deposited thereon.

During filling of the delivery stack 5 the upper working level of the delivery stack 5 is kept at an essentially constant height by measuring the working level by use of sensor devices 51 and lowering the sheet stack continuously or in a stepwise manner by means of a lifting device (not illustrated), thus allowing the sheets 200 to be securely deposited on the sheet stack 5. A sensor unit 50 detects when the maximum stack height in delivery stack 5 is reached, and relays this information to a higher-level control unit (not illustrated).

In the time period between two consecutive sheets 200 this control unit switches the conveying module 2, designed as a mechanical switch point, from position 8 to position 9, so that the subsequent sheets 200 are deposited on the delivery stack 6 via the conveying module 4. Depending on the design of the conveying module 2, this changeover may be achieved by use of one or more pneumatic cylinders or by electric motors (not illustrated).

The delivery stack 5 which is now full is acoustically and/or visually displayed to the operator by means of the control unit, so that the operator is able to remove the delivery stack 5 from its position by using a suitable lift truck and replace the delivery stack with an empty carrier. As soon as the delivery stack 5 has been replaced, the lowest delivery surface of the delivery stack 5 is moved to the referenced upper working level by means of the referenced lifting device, and is then available once again for filling. This state is detected by the sensors 50 and 51 and optionally relayed by additional sensors to the higher-level control unit.

After the maximum stack height is reached in the delivery stack 6 the conveying module 2 switches back to position 8, so that once again the sheets 200 are guided via the conveying module 3 to the delivery stack 5. If the filled delivery stack 5 is not replaced by an empty delivery stack 5 within the time period in which the delivery stack 6 is filled, the higher-level control unit does not send a release signal to the conveying module 2 for changeover of the working positions, and the entire unit ceases operation.

This sequence correspondingly applies to the delivery stack 6 and the sensor units 52, 53. In this case, however, since the maximum height of the delivery stack 6 may be greater than the maximum height of the delivery stack 5 on account of the constructional design, it may be practical to design the sensor unit 52 to have a movable height in order to achieve either identical stack heights or different stack heights for the delivery stacks 5 and 6.

To ensure continuous production operation, in a first embodiment of the invention the conveying modules 1, 2, 3, 4 may run continuously at a synchronized speed, both with respect to one another and with respect to the upstream printing machine.

In a second embodiment of the invention, the speeds of the individual conveying modules 1, 2, 3, 4 may be different from one another and from the speed of the printing machine so that, for example, the distance between the printed sheets may be varied depending on the particular conveying module in question.

In this manner it is possible to optimize time-critical sequences such as the changeover of the conveying route from position 8 to position 9 in the conveying module 2. If, for example, the distances between consecutive sheets 200 are increased in this case by means of a higher speed of the conveying module 2 relative to the conveying module 1, more time is available for changing over the conveying module 2 between positions 8 and 9, resulting in increased reliability. To allow the sheet transfer between two consecutive conveying modules, the suction belts and thus the suction effect thereof may be divided into individual sections 90, 91, 90*a*, 91*a* along the conveying direction, as shown in FIG. 5, which may be independently impinged on by vacuum, i.e., negative pressure.

In addition, the guide devices 30 designed as pull-in rollers or pull-out rollers may be provided as independent units, the speed of which may be selectively adapted to the adjacent conveying modules.

The mode of operation, by way of example, is as follows.

If, for example, a sheet 200 is present on the conveying module 1 shortly before the transfer point to the conveying module 2, as schematically shown in FIG. 5, the sheet is initially still held over section 91 impinged on by vacuum. During further transport the sheet 200 meets the guide device 30, designed as a pull-out roller, and then is also held thereby.

At this time the speed at the guide device 30 is equal to the speed of the conveying module 1. As soon as the sheet 200 is guided by the guide device 30, or shortly thereafter, the vacuum in section 91 of the conveying module 1 is shut off, so that the sheet 200 is then guided only by the guide device 30. While the sheet 200 is being transported by the guide device 30, the speed of the guide device 30 is matched to that of the conveying module 2 so that the sheet 200 may be gripped without slippage and held by the suction belts 11*a* for the conveying module 2 in section 90*a*. As soon as the sheet has traveled past the guide device 30, the speed of the guide device 30 is once again matched to the speed of the conveying module 1. No sheets are present in the guide device 30 during this phase. Depending on the design and the requirements, section 90*a* of the conveying module 2 may be impinged on by a constant vacuum/negative pressure, or may be switched in a similar manner as for sections 91 and 91*a*.

To provide additional protection for the resting sheet surfaces, it may be practical to not only shut off the vacuum in sections 90, 91, 90*a*, 91*a*, but also to generate a slight positive pressure over the suction belts so that the sheets float on an air cushion.

In addition, a delivery device for removing test sheets may be provided. To this end, the conveying module 2, which for example at the time in question is in position 8, is swiveled in a targeted manner into position 9 in order to guide one or more test sheets via the conveying module 4. At the same time, an additional tray 7 is swiveled in above the delivery stack 6, and the test sheets drop into this tray. If the switch point is already in position 9, the additional tray 7 is merely swiveled in to receive the test sheets.

It is practical to remove the test sheets manually by actuation of a control switch by the operator, specifically, as long as the control switch is actuated. Alternatively, a given quantity of test sheets may be removed by specifying a number of desired test sheets in the higher-level control unit by means of user software, the test sheets being automatically deposited in the tray 7 when a control switch is actuated by the operator.

The tray 7 may also be used for depositing spoiled sheets. In each new run of the printing machine, spoiled print sheets are produced until the print image has stabilized, and also as soon as the inking unit is shut off when the printing machine is being slowed down. These printed articles do not have the necessary quality features of the desired printed articles and must be sorted out. For this purpose, the spoiled sheets that are produced during start-up or slowdown of a printing machine are automatically conveyed to the tray 7 by likewise storing a given, freely selectable number of spoiled sheets in the control software for speedup and slowdown operations of the printing machine.

The control unit causes this number of spoiled sheets to be automatically conveyed to the tray 7 during speedup or slowdown operations of the printing machine. In this case the control unit may be manually overridden by the operator without adversely affecting the subsequent production flow.

For this purpose, the tray 7 is swiveled into the conveying route of the sheetlike article in a similar manner as for the conveying module 2. To this end the tray is designed as a collection basket 7*a*, and is rotatably mounted above the shaft 70 and connected, for example, to a pneumatic cylinder (not illustrated) in such a way that when the pneumatic cylinder is actuated the tray 7 is swiveled from a first rest position 71, as illustrated in FIG. 7, to a second working position 72, as illustrated in FIG. 6. In this illustrated position 72 the arriving sheets drop into the tray 7.

When the desired or specified number of test sheets or spoiled sheets is conveyed to tray 7, the tray 7 swivels back to the rest position 71, where the test sheets or spoiled sheets may be easily removed by the operator. The tray 7 may easily be designed as a collection basket, such as a trough-shaped curved panel, or as a grid or the like. The capacity thereof for receiving sheets may be limited to as few as ten sheets.

Furthermore, additionally attached guide elements 73 may be mounted to the underside of the tray 7 which support the depositing of the sheets 200 in the delivery stack 6 when the tray 7 is in position 71 and the sheetlike material is transported to the delivery stack 4 via the conveying module 4.

The invention claimed is:

1. Device for conveying media, by which conveyed media may optionally be fed to various conveying routes, various delivery stacks being provided in particular at the end of the conveying routes, comprising:

at least one suction belt conveying module comprising multiple continuously revolving suction belts separated at a distance, wherein each suction belt is configured to exert a negative pressure on the underside of a medium to be conveyed and to convey the medium from the start to the end of the suction belt conveying module, and wherein the suction belts are guided by means of mutually spaced deflection rollers at an ingress or egress ends of the suction belt conveying module all being positioned on a rotational axis, and wherein the deflection rollers at an ingress or egress end of one suction belt conveying module are situated at least partially between deflection rollers at an egress or ingress end of an adjacent suction belt conveying module;

at least one switch point conveying module being designed as a mechanical switch point in order to reroute a conveyed medium in its conveying route;

wherein a conveying path is composed, at least in some places, of at least two conveying modules, between which a medium may be transferred;

wherein at least two guide devices are provided between the at least two conveying modules to support transfer of a medium between the conveying modules, and wherein the guide device is configurable to modify a conveying speed of a medium between the conveying modules, for which purpose a conveying speed of the guide device is matchable to the speeds of the adjacent conveying modules during a sheet transfer.

2. Device according to claim 1, wherein the switch point conveying module forming a switch point is able to assume at least two mechanical positions in order to guide conveyed media on at least two conveying routes, and an end of the switch point conveying module is displaceable with respect to a start of a respective subsequent conveying module.

3. Device according to claim 2, wherein as a result of a displacement of the end of the switch point conveying module, the end may be positioned at a start of at least two further conveying modules in order to transfer a conveyed medium to a further conveying module.

4. Device according to one of the preceding claims, wherein the switch point conveying module which forms a switch point is rotatably mounted about a swivel axis and configured to be switched to individual swivel positions, and wherein the swivel axis comprises a rotational axis about which a suction belt revolves.

5. Device according to claim 1, wherein the deflection rollers at ingress or egress ends of two adjacent conveying modules have a common rotary shaft.

6. Device according to claim 5, wherein a conveying module includes a cooling plate by which a suction belt and/or an article lying thereon may be cooled.

7. Device according to claim 6, wherein the cooling plate is connected to a separate cooling unit via cooling lines.

8. Device according to claim 6, wherein a conveying module is divided, at least in a region of its ingress or egress end, into at least two functional regions with regard to a suction effect of at least one suction belt.

9. Device according to claim 8, wherein the medium may be transferred in a seamless manner.

10. Device according to claim 8, wherein the at least two functional regions may be independently impinged on by the negative pressure.

11. Device according to claim 9, wherein at least two conveying modules have separate drives with speeds that may be independently adjusted.

12. Device according to claim 11, wherein respective conveying modules have different speeds, for which purpose the conveying modules have separate drives.

13. Device according to claim 1, wherein the conveying speed of a guide device is variable.

14. Device according to claims 13, wherein a guide device is designed as a pull-in roller or a pull-out roller.

15. Device according to claim 13, further comprising:

an apparatus for receiving test sheets, and wherein the apparatus is configured for swiveling into a conveying route.

16. Device according to claim 15, wherein the apparatus for receiving test sheets has additional guide devices which support depositing of the conveyed media in a delivery stack when the apparatus is swiveled out of a transport path of the media.

17. Method for operating a device according to claim 16, wherein a position of a switch point conveying module designed as a switch point is changed as a function of a signal and wherein a conveyed article is transferred in a tangential manner between two conveying modules by providing that the deflection rollers of adjacent conveying modules are at least partially gearing.

18. Method according to claim 17, wherein the signal is emitted by at least one sensor by means of which the stack height of the media deposited in a delivery stack is detected.

19. Method according to claims 17 or 18, wherein an apparatus for receiving test sheets is swiveled into a transport path in order to automatically receive a number of articles in this apparatus.

* * * * *